US005133204A

United States Patent [19]

Wenzel

[11] Patent Number: 5,133,204

[45] Date of Patent: Jul. 28, 1992

[54] APPARATUS FOR PRODUCING SUNKEN SHAPES ON THE OUTER CIRCUMFERENCE OF ROTATIONALLY SYMMETRICAL SHEET-METAL WORKPIECES AND A METHOD FOR PRODUCING THE SAME

[75] Inventor: Helmut Wenzel, Beckum, Fed. Rep. of Germany

[73] Assignee: Leifeld GmbH & Co., Ahlen, Fed. Rep. of Germany

[21] Appl. No.: 717,094

[22] Filed: Jun. 18, 1991

[30] Foreign Application Priority Data

Jun. 25, 1990 [EP] European Pat. Off. ..... 90112026.1

[51] Int. Cl.[5] ..... B21H 1/00

[52] U.S. Cl. ..... 72/91; 72/111

[58] Field of Search ..... 72/80, 82, 91, 105, 72/106, 109, 110, 111, 121, 184, 190

[56] References Cited

U.S. PATENT DOCUMENTS 1,873,164 8/1932 Turnquist ..... 72/105
2,692,004 10/1954 Matheny ..... 72/190
3,396,563 8/1968 Tlaker ..... 72/121
3,473,211 10/1969 Lindell ..... 72/106

*Primary Examiner*—Lowell A. Larson
*Attorney, Agent, or Firm*—Felfe & Lynch

[57] ABSTRACT

Apparatus for the production of sunken shapes in the form of regular or irregular cogs and/or markings on the outer circumference of rotationally symmetrical sheet-metal workpieces. The apparatus includes at least one rotatable spindle with a workpiece holder and at least one applicable pressure roller, with a punch ring which can be superimposed in the spindle's axial direction onto the outer circumference of the workpiece, is concentric with the workpiece, and is rotatable therewith, at least one embossing punch which is held radially displaceably in a corresponding sliding guide in the punch ring and whose length in the radial direction is greater than the radial thickness of the punch ring by at least the radial depth of the indentations, and an intermediate ring which radially externally surrounds the punch ring and the one or more punches guided therein, is mounted floatingly on the punch ring, and can have a radially inwardly directed force applied to it unilaterally by the pressure roll.

11 Claims, 3 Drawing Sheets

Figure 1:
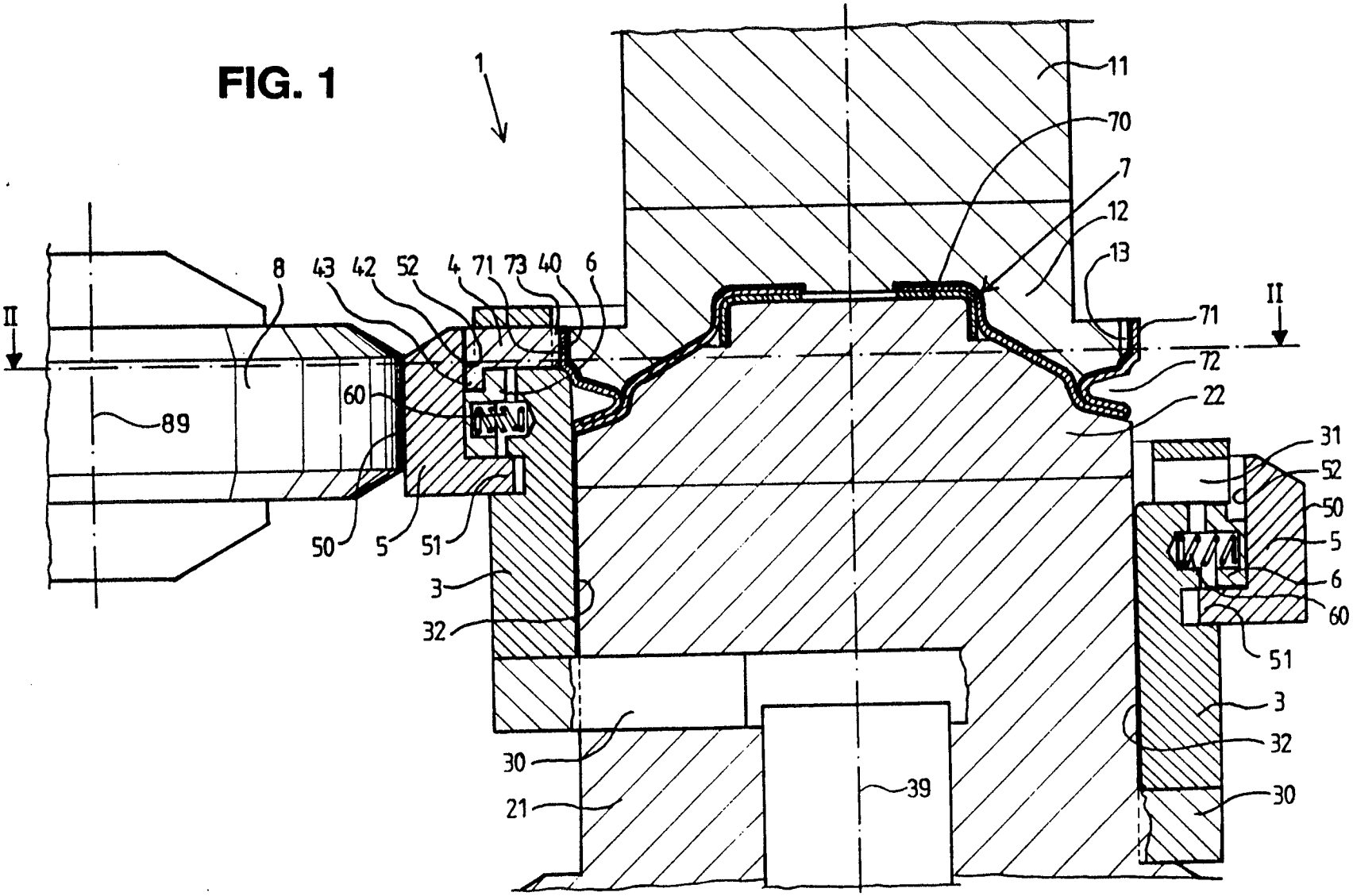

APPARATUS FOR PRODUCING SUNKEN SHAPES ON THE OUTER CIRCUMFERENCE OF ROTATIONALLY SYMMETRICAL SHEET-METAL WORKPIECES AND A METHOD FOR PRODUCING THE SAME

The invention relates to an apparatus for producing sunken shapes on the outer circumference of rotationally symmetrical sheet-metal workpieces and a method for producing the same.

German Pat. No. 37 11 927 discloses, among other things, an apparatus for the production of hollow bodies embossed in the axial direction on their outer circumference, especially cogged metal hollow bodies, from hollow bodies previously given a rotationally symmetrical shape, the embossing being produced by applying pressure by means of at least one embossing roll and performing the shaping step-wise in the radial direction. The apparatus is a pressing machine having a main spindle and a chuck disposed thereon, and having a plurality of embossing rolls of increasing embossing depth which are used successively and which can be driven at an adjustable speed ratio to the main spindle. This apparatus is very useful for the above-mentioned purpose on account of its high accuracy of production; however, it is considered to be a disadvantage that the setting and maintenance of the rotatory speed ratio necessary in each case is relatively cumbersome, and that the machine time per workpiece is comparatively long on account of the successive use of a plurality of embossing rolls.

The problem therefore arises of creating an apparatus of the kind described above, with which, while maintaining equally great accuracy of production with less cumbersome control, shorter work times per workpiece can be achieved. Also, a method for the operation of such an apparatus is to be described.

The solution of the first part of this problem is achieved according to the invention by an apparatus of the kind described above with the distinctive features as follows.

In accordance with the invention, apparatus for the production of an indentation on the outer circumference of rotationally symmetrical sheet-metal workpieces comprises at least one rotatable spindle with a workpiece holder and at least one pressure roller, a punch ring which can be placed onto the workpiece's outside circumference in the direction of a spindle axis, concentric with the workpiece and rotatable with the latter, at least one embossing punch which is mounted in the punch ring for radial displacement in a corresponding sliding guide and whose length in the radial direction is greater by at least the radial depth of an indentation than the radial thickness of the punch ring, and an intermediate ring floatingly mounted on the punch ring and radially externally surrounding the punch ring and the one or more punches guided therein, to which a radially inwardly directed force is applied unilaterally by means of the pressure roller.

Advantageously, in this new apparatus only one spindle drive is needed, since all other revolving parts of the apparatus are driven directly or indirectly from the spindle. The controls in this apparatus are therefore very simple, which contributes to the low manufacturing and operating cost of the apparatus. At the same time the embossing of the workpiece can be produced by a single tool, consisting essentially of a punch ring and embossing punches, which results in a short working time per unit and in economical overall processing. Furthermore, it is an important advantage of the invention that the punch ring, the punches and their arrangement and distribution in the punch ring is freely selectable in wide limits, which permits the production of virtually any embossed pattern on the product. The punches can easily be equipped with large guiding surfaces, which assures a precise, jam-free and low-wear guidance, while the orientation of the punches can also be widely varied, which, for example, makes it possible to produce slanting cogs or other special shapes.

To solve the second part of the problem, a method is proposed for the operation of the apparatus according to the invention, which is characterized by the process steps of as follows.

In accordance with the invention, a method for the production of an indentation on the outer circumference of rotationally symmetrical sheet-metal workpieces, comprises (a) clamping a workpiece on workpiece holders, (b) placing concentrically upon the workpiece a punch ring with embossing punches and an intermediate ring and driving spindles to set in rotation a system including workpiece, punch ring, one or more embossing punches and the intermediate ring, (c) applying a pressure roller radially and in the course of indenting of the workpiece, forcing the intermediate ring out of its initially concentric position gradually to an increasingly eccentric position, while the intermediate ring revolving with its inside circumferential surface shifts the one or more embossing punches in an area of the punch ring facing the pressure roller increasingly radially inwardly and forces them into an outer circumference of the workpiece, (d) retracting the pressure after achievement of the maximum eccentricity of the intermediate ring corresponding to the desired depth of the indentation, shutting off the drive of the spindles and withdrawing axially from the workpiece the punch ring with punches and intermediate ring, and (e) removing the workpiece from workpiece holders. By means of this process it is possible to use the above-described apparatus to produce the shapes described in the outer circumference of the workpiece with little complexity of operation and with very high accuracy.

An additional embodiment of the method is given in as follows. In accordance with the invention, a method in which between the steps (a) and (b) and between steps (d) and (e) stated above, there is the step of performing additional shaping of the workpiece while it is still mounted between workpiece holders. This advantageously makes it possible to perform multiple operations, especially an additional embossing operation on the workpiece without dismounting and remounting the workpiece and without changing machines, which contributes greatly to a low-cost production of the workpieces.

The additional shaping operations consist in impressing circumferential patterns into the workpiece by means of one or more press rollers provided in addition to the press roller, which are successively applied to the workpiece radially. With this embodiment of the method and the corresponding apparatus, it is possible to perform not only the shaping processes of a conventional pressing machine but also the new procedure for producing the embossing on the outer circumference of the workpiece while the workpiece is still mounted.

An important advantage of the invention lies in the fact that, regardless of the radial position of the press roller and the position of the intermediate ring, a uniformly precise, geometrically accurate association between the workpiece and its outside circumference on the one hand, and the punch ring with the embossing punches on the other, is always assured. With the apparatus according to the invention, and by the corresponding method, it is therefore possible to produce the embossing on the outer circumference of rotationally symmetrical workpieces with high accuracy as regards its form and its position. In the case of the workpieces which can be manufactured with the new apparatus and the new method, they can be cogbelt pulleys, belt pulleys with adjustment and/or mounting marks, or incremental indicators for angle and/or speed measurement.

In accordance with the invention, apparatus for the production of sunken contours on the outer circumference of rotationally symmetrical sheet-metal workpieces, comprises at least one rotatable spindle with a workpiece holder and at least one pressure roller. The apparatus includes a punch ring which can be placed onto the workpiece's outside circumference in the direction of a spindle axis, concentric with the workpiece and rotatable with the latter. The apparatus includes at least one embossing punch which is mounted in the punch ring for radial displacement in a corresponding sliding guide and whose length in the radial direction is greater by at least the radial depth of the indentation than the radial thickness of the punch ring. The apparatus also includes an intermediate ring floatingly mounted on the punch ring and radially externally surrounding the punch ring and the one or more punches guided therein, to which a radially inwardly directed force is applied unilaterally by means of a pressure roller.

For a better understanding of the invention, together with other and further objects thereof, reference is made to the following description, taken in connection with the accompanying drawings, and its scope will be pointed out in the appended claims.

Figure 2:
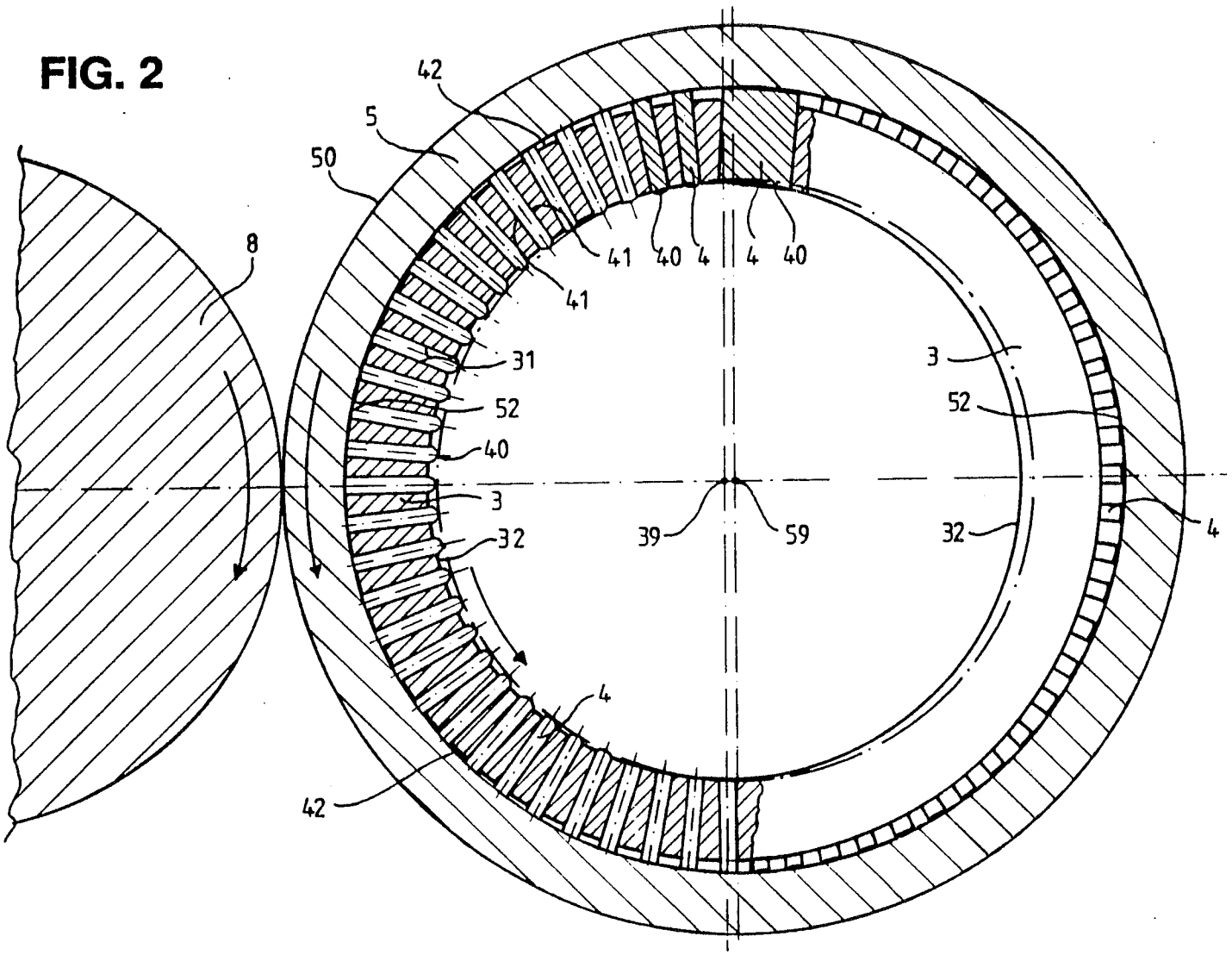
Figure 3:
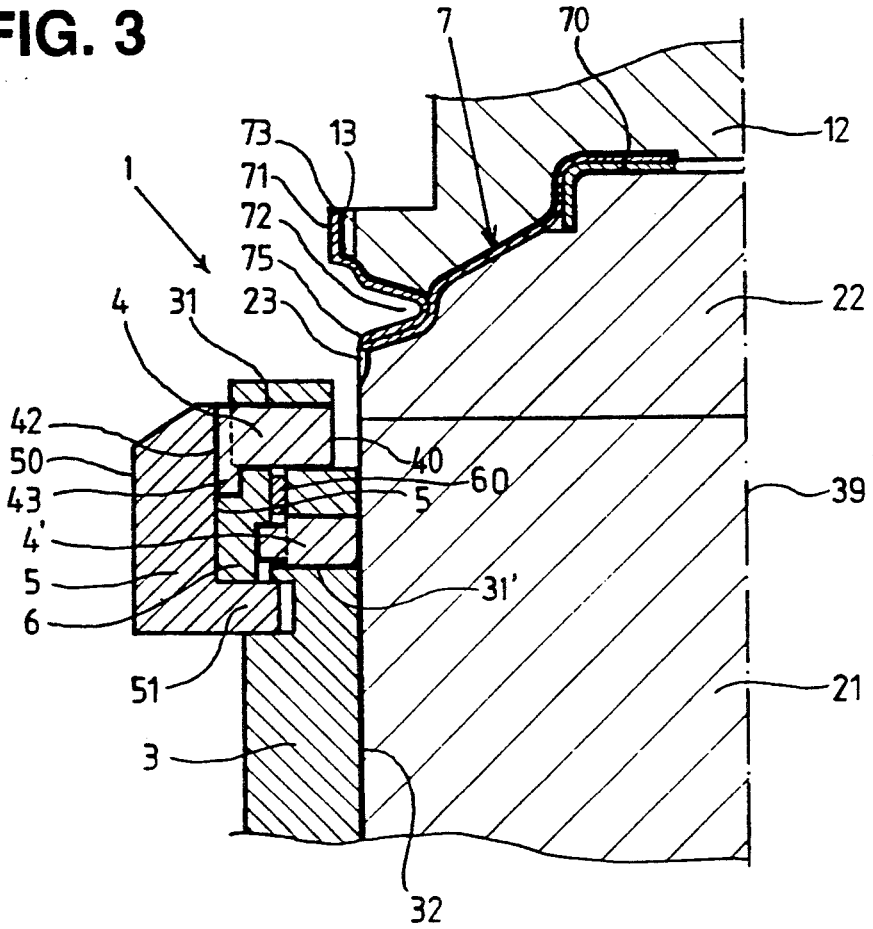
Figure 4:
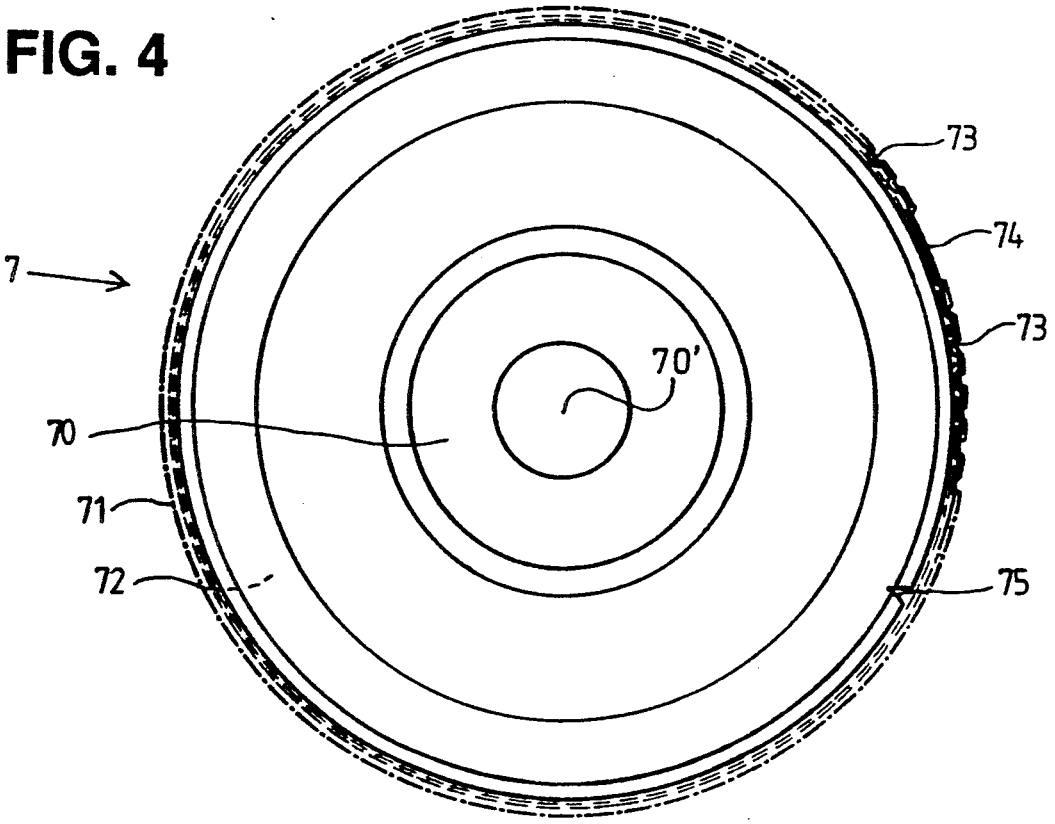

Referring now to the drawings:

FIG. 1 shows an apparatus in longitudinal section, partially in perspective; the right half of the figure shows the apparatus in the state before the workpiece is embossed and the left half shows it during the embossing of the workpiece, FIG. 2 shows the apparatus of FIG. 1 in a cross-section along line II—II in FIG. 1, FIG. 3 is a fragmentary longitudinal section of the apparatus in a modified form, and FIG. 4 shows an example of an embossed workpiece.

As FIG. 1 of the drawing shows, the embodiment of the apparatus 1 here depicted consists essentially of two spindles, namely a first, upper spindle 11 in FIG. 1, and a second, lower spindle 21 in FIG. 1. Each of the two spindles 11 and 21 is equipped at their extremities with a workpiece holder 12 and 22, which between them clamp a rotationally symmetrical workpiece 7, which in this case is a V-belt pulley. At least one of the two spindles 11 and 21 is equipped with a rotary drive not actually shown, but it is preferable that both spindles 11 and 21 be driven synchronously.

A punch ring 3 is concentrically mounted on the lower spindle 21 with a sliding fit; it is axially displaceable on spindle 21 by means of a supporting ring 30, but is held unrotatably in the circumferential direction thereon. The spindles 11 and 21 and the punch ring 3 are rotatable in common about a central axis 39 by the spindle drive or drives.

On the right side of FIG. 1 is shown the state of the apparatus 1 prior to the embossing of the workpiece 7, in which the punch ring 3 is in a downwardly shifted starting position. The lower part of the punch ring 3 serves with its smooth internal circumferential surface for the guidance of the punch ring 3 on the spindle 21. In its upper-end portion the punch ring 3 is provided with circumferentially distributed and radially disposed guides 31 in the form of slots, one guide 31 being visible in FIG. 1 on the right side. The guides 31 serve each to accommodate one embossing punch 4, which is omitted on the right side of FIG. 1 for ease in comprehension. Its shape, however, can be seen on the left side of FIG. 1.

An intermediate ring 5 runs externally around the punch ring 3 and is mounted floatingly on the punch ring 3 by means of a guiding flange 51. Inwardly the intermediate ring 5 has an inside circumferential surface extending over most of its height and describing a cylindrical surface. Outwardly, the intermediate ring 5 has an outside circumferential surface 50 which is also cylindrical.

Between the punch ring 3 and the intermediate ring 5 there is also disposed a supporting ring 6, which is also mounted floatingly. The supporting ring 6 is biased with a force directed radially outward by a retracting system 60, which here is a plurality of coil springs disposed radially between the punch ring 3 and the supporting ring 6. Alternatively, the retracting system 60 can be a resiliently compressible ring, a hydraulic or pneumatic device, or any other appropriate device. At its upper end the supporting ring 6 is situated just underneath the guide slot 31 and forms a radially external surface which is movable radially and supports the embossing punch 4 in the punch guiding slot 31.

On the right-hand side of FIG. 1, above the system consisting of the punch ring 3, the intermediate ring 5 and the supporting ring 6, can be seen the workpiece 7, which here is configured with a substantially V-shaped V-belt groove 72 plus a cylindrical outer circumferential portion 71 above it; the latter is to be embossed with a pattern which is produced by means of the embossing punches 4, and for which purpose the workpiece holder 12 on the first, upper spindle 11 has a corresponding negative pattern 13.

On the portion of FIG. 1 to the left of the axis of rotation 39, the apparatus is depicted in a state during the embossing of the workpiece 7. The punch ring is now shifted upward along its inside circumferential surface 32 and the outside circumferential surface of spindle 21 until the embossing punch 4 visible in the left portion of FIG. 1 is precisely at the level of the cylindrical outside circumference 71 of the workpiece 7. Another difference from the state of the apparatus depicted on the right-hand side of FIG. 1 is that now the intermediate ring 5 is shifted from its position concentric with the punch ring 3 to an eccentric position. This shift is performed by means of a pressure roller 8 which can be applied radially and which is freely rotatable about an axis 89 which is parallel to the axis 39. Optionally, a drive synchronous with the spindle drive can also be provided for the pressure roller 8. The outer circumference of the pressure roller 8 engages the outer circumference 50 of the intermediate ring 5 and shifts it radially inward at the portion facing the pressure roller 8, i.e., to the right in FIG. 1. By this movement of the intermediate ring 5 the embossing punches 4 are also shifted radially inward in the area facing the pressure roller 8, while the ends 40 of the embossing punches 4 are pressed into the outer circumferential area 71 of the workpiece 7, thereby embossing the latter. The application of the roller 8 is continued until the intermediate ring 5 has reached a maximum eccentricity corresponding to the desired embossing depth, thus producing the desired shapes—cogs 73 in this case—on the outer circumference 71 of the workpiece 7.

As it is also to be seen on the left side of FIG. 1, the upper end area of the supporting ring 6 engages a butt portion 43 provided on the embossing punch 4, whereby the force exerted on the supporting ring 6 by means of the retracting system 60 is transmitted to the individual embossing punches 4 to retract them.

The cross section shown in FIG. 2, taken along line II—II in FIG. 1, clarifies especially the relative shifting of the intermediate ring 5 and embossing punches on the one hand and of the punch ring 3 on the other, the state of maximum eccentricity of the intermediate ring 5 at the end of the work being here represented. Furthermore, FIG. 2 shows that both the punch ring 3 and the intermediate ring 5 are of a circular shape and differ only in diameter. The inside diameter of the punch ring 3 corresponds substantially to the outside diameter of the workpiece 7, which is not actually shown in FIG. 2, and clearance is provided between the two diameters as necessary for installation and removal. Furthermore, FIG. 2 shows that the radial dimension of the embossing punches 4 is greater than the radial thickness of the punch ring 3 in which the punches 4 are guided for radial displacement by means of guiding surfaces 41 and guides 31. The radial dimension of the punches 4 exceeds the radial thickness of the punch ring, at least by the depth of the shaping to be performed on the outer circumferential area 71 of the workpiece 7.

The inside diameter of the intermediate ring 5 is, again, selected such that, if it is arranged concentrically with the punch ring 3, it will contact the back surfaces 42 of the punches 4 such that the latter will be precisely flush at their ends 40 with the inside circumferential surface 32 of the punch ring 3.

In the state depicted in FIG. 2, in which the intermediate ring 5 has reached its maximum eccentricity after the application of the pressure roller 8, the embossing punches 4 in the area of punch ring 3 confronting the pressure roller 8 protrude beyond the inner circumference 32 of the punch ring 3, by the depth of the desired embossing. In the part of the punch ring 3 that is 180° away from the pressure roller 8, i.e., to the right in FIG. 2, the ends 40 of the embossing punches 4 are retracted outwardly behind the inside circumferential surface 32 of the punch ring 3 by a length corresponding to the depth of the embossing.

At the center of the drawing of FIG. 2, two parallel axes of rotation 39 and 59 are drawn, which are perpendicular to the plane of drawing, and of which the axis 39 is associated with the punch ring and axis 59 with the intermediate ring 5.

On the basis of the above-described sizes of the individual parts, the inside circumferential surface 52 of the intermediate ring 5 lies constantly at the back surfaces 42 of all embossing punches 4, so that the punches 4 accompany the eccentric rotation of the intermediate ring 5.

Lastly, it is also indicated in the upper part of FIG. 2 that the punches 4 can easily have different shapes, e.g., different sizes in the circumferential direction or in the axial direction. FIG. 3 in the drawing shows a modified construction of the apparatus 1, in which the parts of this apparatus 1 are provided in their modified design with the reference numbers corresponding to the same parts as in the previously described embodiment of the apparatus 1. To simplify the drawing, only the left half of the apparatus 1 on the left of the axis of rotation as well as axis of symmetry 39 is shown. In the upper part a portion of the workpiece holder 12 is visible, which is adjoined at the bottom by the workpiece 7 with its central hub portion 70, its circumferential V-belt groove 72, and its cylindrical circumferential area 71. Under the workpiece 7 the second workpiece holder 22 of the second spindle 21 is visible. On the left of the spindle 21, the punch ring 3 surrounding the latter is visible, which here, unlike the previously described design of the apparatus 1, is provided with two sliding guides 31 and 31', the upper sliding guide 31 serving to hold the punch 4 and the lower sliding guide 31', serving to accommodate a second punch 4'. This is followed radially outwardly by the intermediate ring 5, while here, again, the supporting ring 6 is disposed between the punch ring 3 and the intermediate ring 5. The retracting system 60 consists here of a resiliently compressible annular body which is disposed between an outer surface of the punch ring 3 and an inner surface of the supporting ring 6.

If, in the case of apparatus 1 according to FIG. 3, the punch ring with the embossing punches 4, 4', and the intermediate ring 5 and supporting ring 6 are shifted axially upwardly to their working position, the punches 4, as described previously in the case of the first embodiment of the apparatus 1, come opposite the lower flank of the V-shaped V-belt groove 72, and there produce a notch marking 75. To permit the unhampered inward radial movement of the lower punch 4', the lower workpiece holder 22 is provided at the corresponding point on its outer circumference with a matching negative shape 23, a notch in this case. With the apparatus 1 here described, therefore, two indentations separate from one another in the axial direction are made on the workpiece 7.

Lastly, FIG. 4 shows a front face view of a workpiece 7 made with the above-described apparatus 1 by the corresponding method for the operation of the apparatus. The central part of the workpiece 7 forms the hub 70 with a central opening 70', to accommodate an axle, for example. This is followed radially outwardly by the here-unseen V-belt groove 72 as well as the cylindrical outer circumferential area 71, which here is already provided with a cogged shape which serves as incremental cogging. The incremental cogging 73 consists of individually formed indentations, while a flattened portion 74 occurs once on the circumference of the workpiece 7. The single mark 75 in the form of a notch is created in the one flank of the V-belt groove 72, and serves as an installation or adjustment marking.

The cogs or indentations of the cogging 73 in the outer circumferential area 71 are distributed at uniform intervals over the entire circumference of the workpiece 7, but in FIG. 4, for the sake of simplifying the drawing, they are shown on only part of the circumference.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Apparatus for the production of an indentation on the outer circumference of rotationally symmetrical sheet-metal workpieces, the apparatus comprising:

at least one rotatable spindle with a workpiece holder and at least one pressure roller;

a punch ring which can be placed onto the workpiece's outside circumference in the direction of a spindle axis, concentric with the workpiece and rotatable with the latter;

at least one embossing punch which is mounted in the punch ring for radial displacement in a corresponding sliding guide and whose length in the radial direction is greater by at least the radial depth of an indentation than the radial thickness of the punch ring; and an intermediate ring floatingly mounted on the punch ring and radially externally surrounding the punch ring and the one or more punches guided therein, to which a radially inwardly directed force is applied unilaterally by means of the pressure roller.

2. Apparatus according to claim 1, which includes between the punch ring and the intermediate ring with radial clearance a supporting ring which lies under the one or more punches and supports the latter, and a retracting system for applying a force acting radially outwardly to the supporting ring.

3. Apparatus according to claim 2, in which the supporting ring contacts the one or more punches, from behind and in which the one or more punches, and the supporting ring are biased by a force acting radially outwardly.

4. Apparatus according to claim 1, which includes two synchronously drivable, aligned spindles, each with a workpiece holder, the workpiece holders, holding a workpiece on the one side and another side, clamping the workpiece between them and being drawn apart from one another for the insertion and removal of the workpiece.

5. Apparatus according to claim 4, in which the workpiece holder has in the area lying in back of an indentation of the workpiece a corresponding negative indentation.

6. Apparatus according to claim 4, in which the workpiece holder is smooth-surfaced in an area lying in back of an indentation of the workpiece.

7. Apparatus according to claim 1, in which one or more embossing punches are disposed in the punch ring in two or more axially separated planes.

8. Apparatus according to claim 1, which includes a supporting ring which is concentric with the at least one spindle, displaceable axially with respect thereto, and co-rotational therewith.

9. Method for the production of an indentation on the outer circumference of rotationally symmetrical sheet-metal workpieces, comprising:

a) clamping a workpiece on workpiece holders, b) placing concentrically upon the workpiece a punch ring with embossing punches and an intermediate ring and driving spindles to set in rotation a system including workpiece, punch ring, one or more embossing punches and the intermediate ring, c) applying a pressure roller radially and in the course of indenting of the workpiece, forcing the intermediate ring out of its initially concentric position gradually to an increasingly eccentric position, while the intermediate ring revolving with its inside circumferential surface shifts the one or more embossing punches in an area of the punch ring facing the pressure roller increasingly radially inwardly and forces them into an outer circumference of the workpiece, d) retracting the pressure after achievement of the maximum eccentricity of the intermediate ring corresponding to the desired depth of the indentation, shutting off the drive of the spindles and withdrawing axially from the workpiece the punch ring with punches and intermediate ring, and e) removing the workpiece from workpiece holders.

10. Method according to claim 9, in which between the steps a) and b) and between steps d) and e), performing additional shaping of the workpiece while it is still mounted between workpiece holders.

11. Method according to claim 10, which includes impressing circumferential patterns into the workpiece by means of one or more successive, radially applied pressure rolls provided in addition to the pressure roll for performing the additional shaping.

* * * * *